US006908531B2

(12) United States Patent
Hietanen et al.

(10) Patent No.: US 6,908,531 B2
(45) Date of Patent: Jun. 21, 2005

(54) CALENDERED PAPER PRODUCT AND METHOD OF PRODUCING A CALENDERED PAPER WEB

(75) Inventors: Soili Hietanen, Espoo (FI); Markku Leskelä , Muijala (FI)

(73) Assignee: M-Real Oyj, Espoo (FI)

( * ) Notice: Subject to any disclaimer, the term of this patent is extended or adjusted under 35 U.S.C. 154(b) by 112 days.

(21) Appl. No.: 10/182,130

(22) PCT Filed: Jan. 29, 2001

(86) PCT No.: PCT/FI01/00082

§ 371 (c)(1),
(2), (4) Date: Oct. 23, 2002

(87) PCT Pub. No.: WO01/55505

PCT Pub. Date: Aug. 2, 2001

(65) Prior Publication Data

US 2003/0056915 A1 Mar. 27, 2003

(30) Foreign Application Priority Data

Jan. 28, 2000 (FI) ..... 20000184

(51) Int. Cl.[7] ..... D21H 11/02; D21H 19/72

(52) U.S. Cl. ..... 162/135; 162/136; 162/141; 162/142; 162/149; 162/150

(58) Field of Search ..... 162/91, 135, 136, 162/141, 142–149, 150

(56) References Cited

U.S. PATENT DOCUMENTS 4,548,675 A * 10/1985 Gordy ..... 162/26
5,171,627 A * 12/1992 Brockington et al. ..... 428/220
5,425,851 A 6/1995 Cason et al. ..... 162/206
6,406,592 B2 * 6/2002 Leskela et al. ..... 162/142
6,436,238 B1 * 8/2002 Pitkanen et al. ..... 162/182
6,712,931 B1 * 3/2004 Gron et al. ..... 162/128

FOREIGN PATENT DOCUMENTS

| | | |
|---|---|---|
| EP | 0 902 119 A2 | 3/1999 |
| EP | 0 908 557 A1 | 4/1999 |
| EP | 0 908 561 A1 | 4/1999 |
| FI | 103417 B | 3/1999 |
| SE | 500 472 C2 | 7/1994 |
| WO | 87/02722 A1 | 5/1987 |

OTHER PUBLICATIONS

Casey,Pulpand Paper, 1980, John Wiley & Sons, 3rd Ed., vol. 1, pp 245–247.*

Kojio, Mikko, *Papermaking: Finishing,* Tappi, pp. 23–24, 1999.

Carl–Anders Lindholm, "Comparison of some papermaking properties of groundwood, pressure groundwood and thermomechanical pulp by means of artificial blends of pulp fractions", *Paperi ja Puu Papper och Trä,* No. 10, pp. 593–606, 1980.

Croon, Ingemar, "Fast growth ahead for aspen CTMP", *PPI,* pp. 36–37 and 55, Mar. 1990.

* cited by examiner

*Primary Examiner*—Peter Chin
(74) *Attorney, Agent, or Firm*—Kubovcik & Kubovcik

(57) ABSTRACT

The invention relates to a method for producing a calendered paper web. According to the method, a paper web is formed from a fibrous raw material in a paper machine, and the paper web is calendered. According to the invention, a fibrous raw material is used which is at least partly made up of a chemimechanical pulp of a species of the *Populus* family, and the calendering is performed by online soft-calendering. By means of the invention, the gloss and smoothness of papers can be improved without decreasing their bulk.

21 Claims, 3 Drawing Sheets

CALENDERED PAPER PRODUCT AND METHOD OF PRODUCING A CALENDERED PAPER WEB

Figure 1:
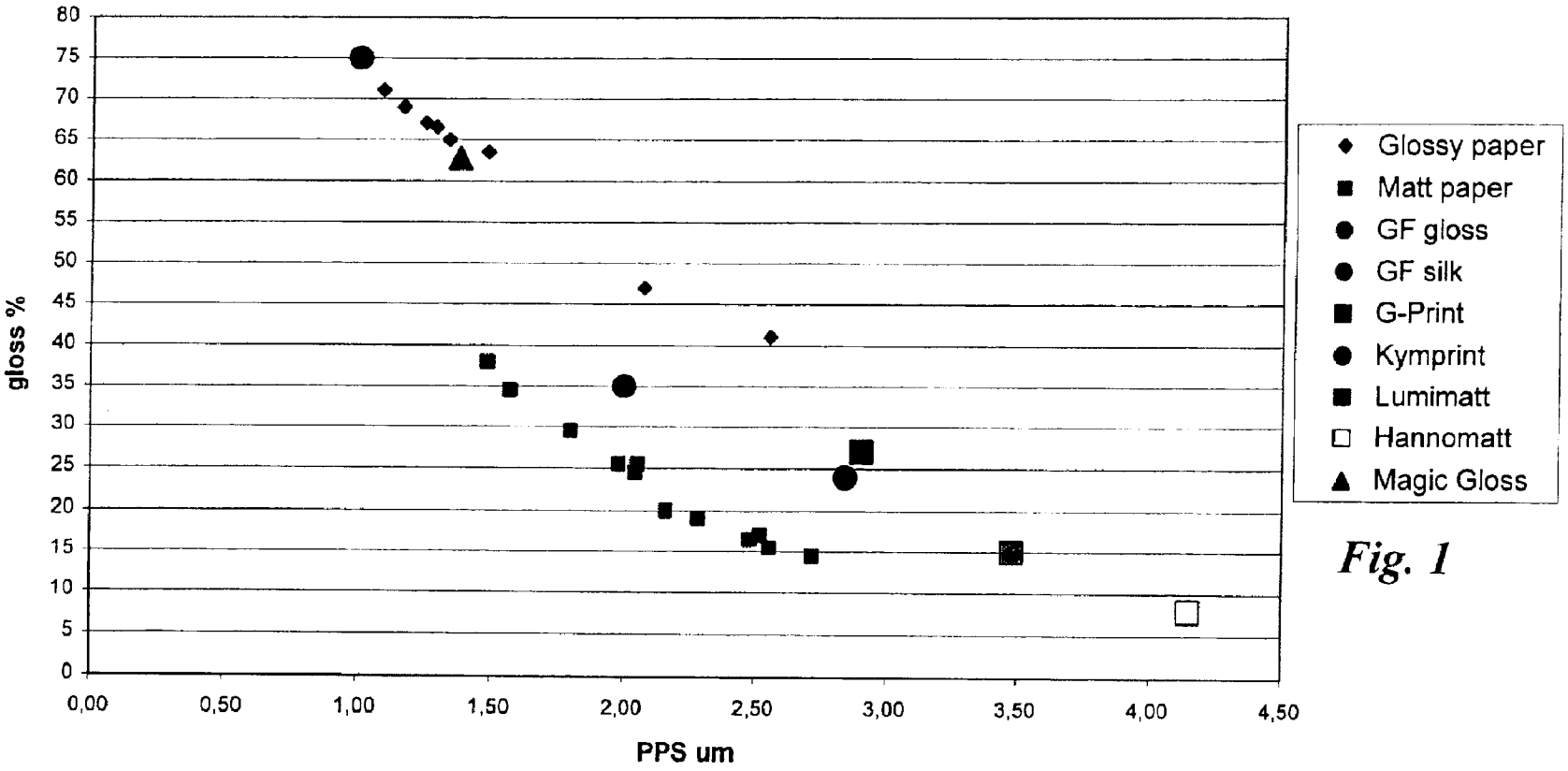

The present invention relates to a method for producing a calendered paper web.

According to such a method a paper web is formed in the paper machine from a fibrous raw material and the web is calendered.

The invention also relates to a method for producing a coated and calendered paper having a predetermined gloss and to a calendered paper product.

Calendering is a very important product treatment step in the production of most paper grades. In calendering, the surface of the paper is evened so that the surface becomes smooth, any variations in the thickness of the paper are evened out, and the paper becomes glossy in the desired manner. In calendering the printing properties of the paper are ultimately brought to the level required for a printed product so that, for example, the gloss of the printed surface is as high as possible.

There are a number of calendering techniques. If the gloss of papers is above approx. 40–50% (Hunter gloss, 75°), they are called glossy papers. The calendering process is in this case usually so-called supercalendering, although there are also other, less often used options for, for example, boards. Respectively, if the gloss of papers is below 40–50%, they are called matt, silk or satin papers. According to whether glossy paper or matt paper is concerned, the surface material of the calender rolls and the calender process conditions, above all the roll temperatures and the nip pressure, but possibly also the calender speed and steaming, are set at different values. While with glossy paper the aim in principle is to achieve as high a gloss as possible, matt paper is above all desired to be very smooth, but so that the structure of the surface will not reflect light in the manner of glossy paper.

There are two significant problems involved with calendering. First, a well-known disadvantage caused by calendering is that, as the gloss and/or smoothness of the paper increases during calendering, the thickness and bulk of the paper are reduced considerably. A decrease in bulk is in practice always also associated with a decrease in the opacity and stiffness of the paper.

The other problem, significant in a supercalendering process implemented as a separate process step, is that the running speed of the calenders is slower than that of a modern paper machine. The design speeds of new printing paper machines are currently in the order of up to 1800 m/min, whereas the speed of, for example, supercalenders has long been in the order of 500–800 m/min.

Since the running speed of the supercalender has been lower than that of a paper machine or a coating machine, it has been necessary to acquire several supercalenders for a paper mill for the after-treatment of the increased production quantities of the actual paper making. Several solutions weakening the efficiency and the working conditions of the paper mill have resulted: It has been necessary always to stop the calender for the duration of roll replacements, which has resulted in loss of time and in the roll start offage. The extra process step requires hoists, the use of which involves risks of occupational safety. An offline calender placed separately from the paper machine line requires more space than if the same apparatus were placed in connection with the paper machine or the coating machine. The energy requirement in an offline calender is also higher, since the paper needs to be reheated. The lathe-turning of the supercalender rolls is a separate cost-inducing work step, which should preferably be entirely eliminated. Furthermore, since each supercalender requires a running crew for shift work, and if there are several supercalenders, this causes a significant cost to the mill.

The production capacity of a supercalender has in practice been limited by the fact that it has not been possible to place simultaneously high temperature loads and high pressure loads on rolls made of natural materials. The risk has been damage to the rolls in the lowest roll nips of supercalenders.

In order to avoid roll damage, the running method has in practice been that the upstream rolls have been run at high temperatures but low pressures. Even though the paper web does thus become heated, owing to the low pressure the transfer of heat is not the best possible. While traveling through several roll nips the paper is gradually heated up and thereby becomes more formable. In the nips of the downstream end of the supercalender it has respectively been possible to increase the pressure, but the limit has been the above-mentioned risk of roll damage. The end result is that the paper is ultimately calendered if there are enough roll nips.

A running method such as this is, however, very inefficient, and the process running speed remains low. If the speed were increased, the paper would not have time to heat up and would arrive too cold at the so-called bottom rolls. The result would be insufficient quality of the paper.

The fact that the forming of paper gloss is in this manner indirectly dependent on the running speed of the supercalender also leads to an additional problem. Since it has been necessary always to stop the supercalender for the duration of roll replacement, the quality, in particular the gloss, of paper varies during the acceleration and braking of the supercalender. This results in waste paper and lost production time.

From the slow heating up of paper there also follows the disadvantage that the entire paper (in the z direction) is heated, whereas in terms of calendering it would be optimal if only the surfaces were heated. Paper is better formable (the polymers present in the paper are better formable) the warmer it is. The purpose is specifically to form the paper surfaces and to avoid compression of the inner part of the paper, in order also to obtain bulk, opacity and stiffness in the paper.

Recently, the so-called soft-calendering technique has made progress owing to the development of roll materials. The end result is that at present it is possible to construct from large-diameter rolls calender nips at which the temperatures and pressures are, in terms of the calendering of the product, such that the soft-calender can be placed even directly in the paper machine line. The linear pressure of a soft-calender is typically above 200 kN/m and may be up to 450–600 kN/m, whereas in supercalendering it remains typically below 200 kN/m. The quality of the final product has been sufficient, in particular in matt-surfaced paper grades, but the production of sufficiently glossy grades in the category of glossy papers has not been quite successful.

The object of the present invention is to eliminate the problems involved with the prior art and to provide a novel option for the smoothing and glazing of paper.

The invention is based on the surprising observation that, when there is used in the base paper a chemimechanical pulp in which at least the major proportion of the fibers are aspen fibers or corresponding wood fibers, it is possible by suitable calendering to achieve simultaneously a high smoothness and a high gloss, and a considerably better opacity, bulk and stiffness than in reference papers. This technique solves the calendering problem that has been associated with the production of both matt and glossy papers. In the invention there is thus used a fibrous raw material which is at least in part made up of a chemimechanical pulp of a wood species of the *Populus* family, and the calendering is carried out by online soft-calendering. A coated paper web can be used for producing papers having a gloss above 50% by performing the calendering at a temperature of 120–170° C. and a linear pressure of 250–450 kN/m. Respectively, from the same paper web there is obtained paper having a gloss below 50% if the calender rolls are not substantially heated and if the calendering is carried out at a linear pressure of 200–350 kN/m.

By means of the invention, there is obtained a calendered paper in which, in the mechanical pulp present in it, at least 20–40% by weight of the fibers are in the fiber size fraction of 28/48 mesh and at least 20% by weight in the fiber size fraction of <200 mesh.

The invention provides considerable benefits. Thus the invention can be exploited in the calendering of both glossy papers and matt papers, but in practice the online calendering provides a clear improvement specifically for the production of glossy papers. As is evident from the examples presented below, by means of the invention it is possible to improve the gloss and smoothness of papers without lowering their bulk. In fact, by the method according to the invention, a product glossier and smoother than commercial paper grades is obtained with a bulk at least 5% higher. The benefits of the invention are manifest in particular in the calendering of coated papers.

It has further been observed, surprisingly, that with coatings containing mainly gypsum as the pigment, the brightness and opacity of papers treated according to the invention are further improved.

According to the invention, one and the same paper web can be used for producing both glossy paper grades and matt papers by varying the conditions of calendering.

In the following, the invention will be examined in more detail with the help of a detailed description and with reference to the annexed drawings.

Figure 2:
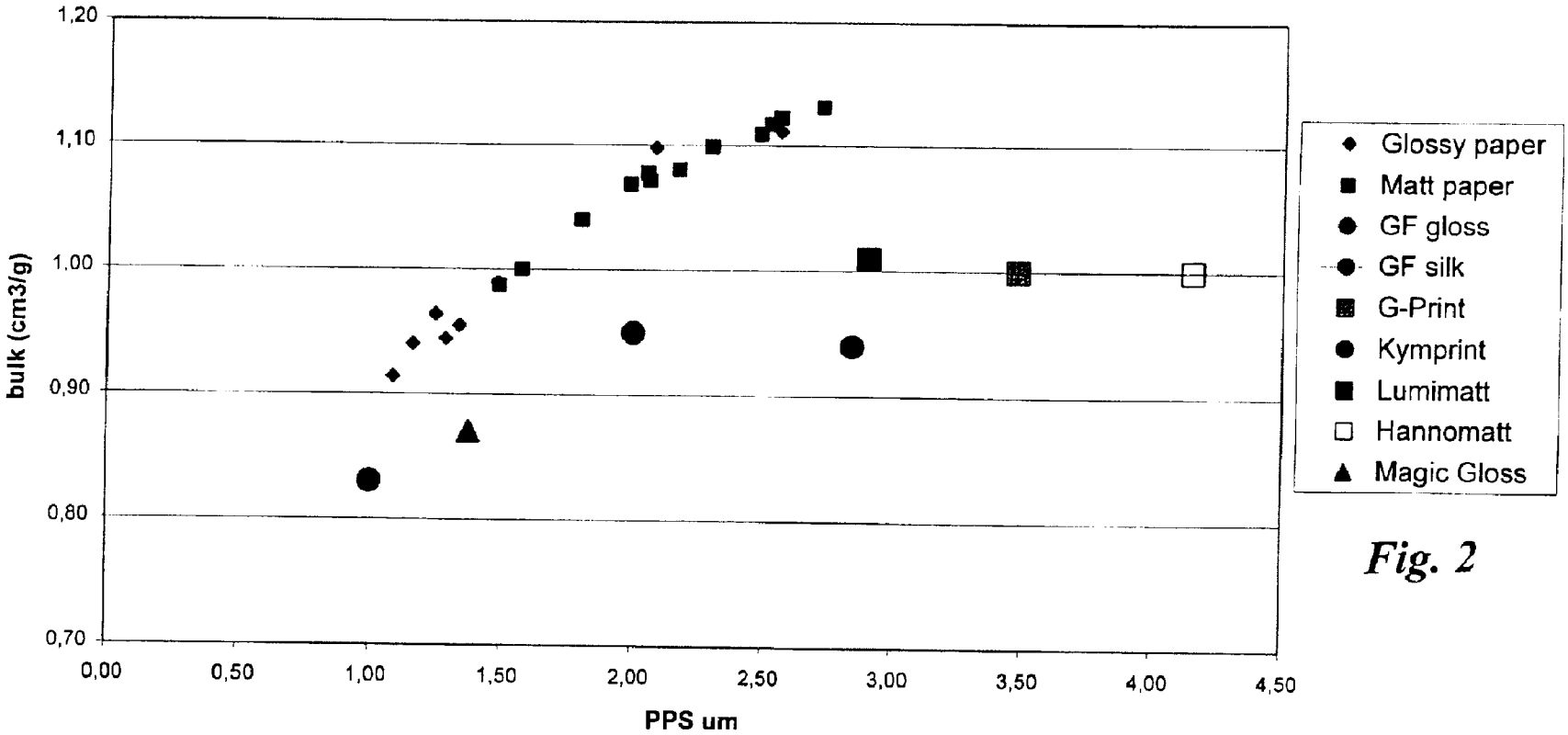
Figure 3:
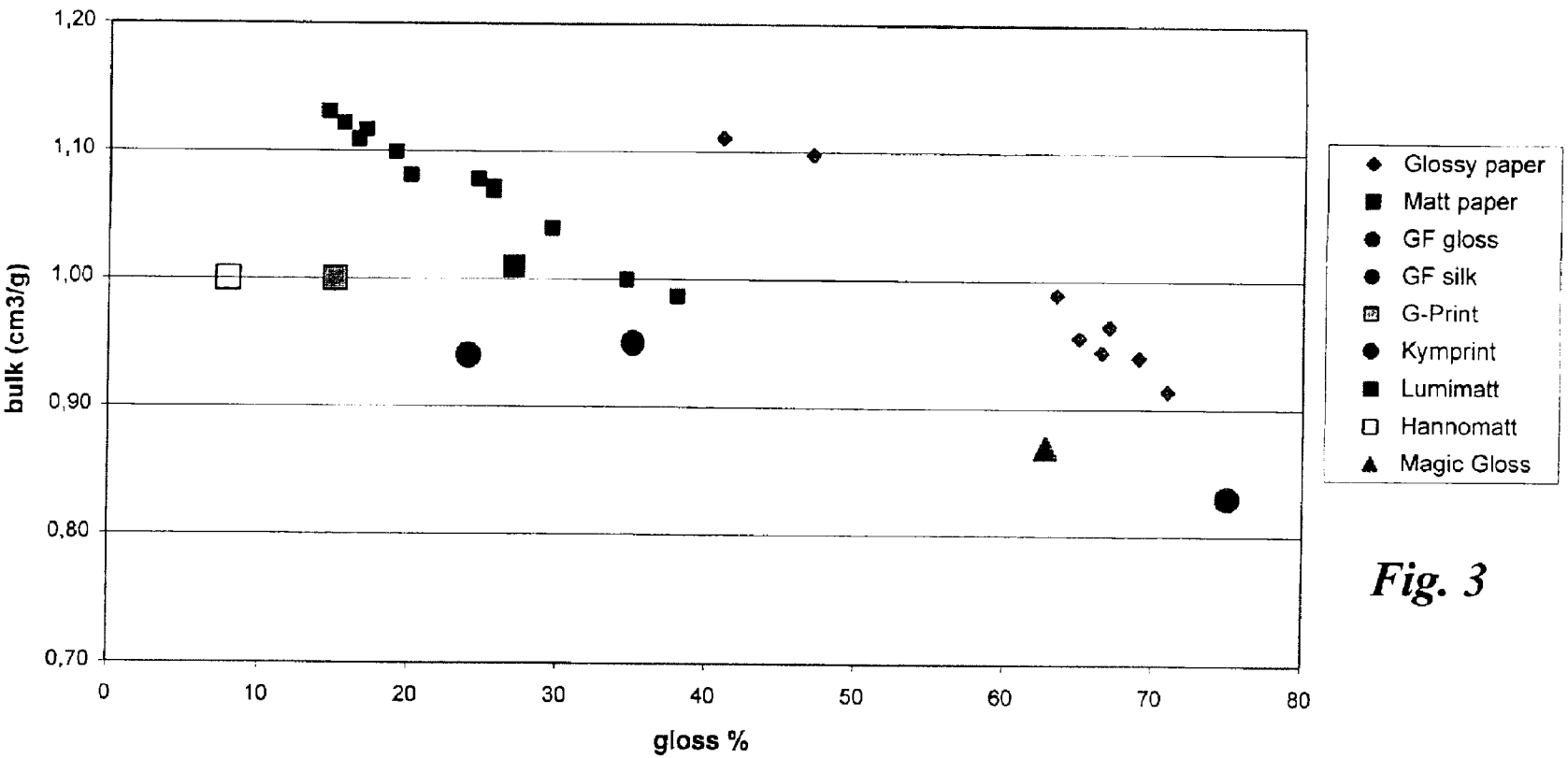

FIG. 1 depicts the gloss of eight different paper grades as a function of smoothness, FIG. 2 depicts the bulk of the same paper grades as a function of smoothness, and FIG. 3 further depicts the bulk of the same paper grades as a function of gloss.

It should be pointed out that, even though in many places in the following description only aspen is mentioned as the raw material for the chemimechanical pulp, the invention can, however, similarly be applied to other wood species of the *Populus* family. In general, wood from, for example, the following wood species are suitable for use in the invention: *P. tremula, P. tremuloides, P. balsamea, P. balsamifera, P. trichocarpa, P. heterophylla, P. deltoides* and *P. grandidentata*. Aspen (Finnish indigenous aspen, *P. tremula*; so-called Canadian aspen, *P. tremuloides*) and aspen species crossbred from various parent aspens, so-called hybrid aspens (e.g. *P. tremula×tremuloides, P. tremula×tremula, P. deltoides×trichocarpa, P. trichocarpa×deltoides, P. deltoides×nigra, P. maximowicziiχtrichocarpa*) and other species produced by gene technology, as well as the poplar, are regarded as especially advantageous. From them it is possible to produce a chemimechanical pulp having sufficiently good fiber properties and optical properties for use in the present invention.

Preferably a chemimechanical pulp having a suitable fiber distribution is used, of the fibers of which at least 30%, advantageously at least 50%, and preferably at least 70% are derived from aspen, hybrid aspen or poplar. According to an especially preferred embodiment, there is used in the invention an aspen CTMP of the fibers of which at least 20% by weight are in the fiber size fraction of <200 mesh. Preferably there is used an aspen CTMP of the fibers of which 20–40% by weight, preferably approx. 25–35% by weight, are in the fiber size fraction of 28/48 mesh and 20–40% by weight, preferably approx. 25–35% by weight, in the fiber size fraction of <200 mesh. By 28/48 mesh is meant in this case a fraction which passes a wire having a mesh of 28, but which is retained on a wire of 48 mesh. Such a fraction contains fibers which provide a suitable bulk and stiffness for a paper layer. The fiber size fraction which passes the densest wire (<200 mesh) for its part provides a high surface smoothness. The pulp concerned can be produced in a manner known per se by a chemimechanical process having several refining steps, for example two steps, and thereafter reject classification and reject refining. The fiber size distribution is adjusted to the desired value by the joint effect of these steps.

By chemimechanical pulp production is meant in the present invention a process comprising both a chemical and a mechanical defibration step. Chemimechanical processes include the CMP and CTMP processes; in the CMP process the wood raw material is refined under normal pressure, whereas in the CTMP process a pressure refiner pulp is prepared. The yield of the CMP process is in general lower (less than 90%) than that of the CTMP process, which is due to the fact that its chemicals dosage is larger. In both cases the treatment of the wood with chemicals is conventionally performed with sodium sulfite (sulfonation treatment), in which case hardwood can also be treated with sodium hydroxide. A typical chemicals dosage in the CTMP process is in this case approx. 0–4% sodium sulfite and 1–7% sodium hydroxide and the temperature is approx. 60–120° C. In the CMP process the chemicals dosage is 10–15% sodium sulfite and/or 4–8% sodium hydroxide (dosages calculated from dry wood) and the temperature is 130–160 and respectively 50–100° C.

In the chemimechanical process the chips may also be impregnated with an alkaline peroxide solution (APMP process). The peroxide dosage is in general 0.1–10% (of the weight of dry pulp), typically approx. 0.5–5%. An alkali, such as sodium hydroxide, is added in the same amount, i.e. approx. 1–10% by weight.

The raw material of the CTMP process may consist of only aspen or some other wood of the poplar family, but it is also possible to incorporate into it other species, such as hardwood, e.g. birch, eucalyptus and mixed tropical hardwood, or softwood, such as spruce or pine. According to one embodiment, a chemimechanical pulp is used which contains at least 5% softwood fibers. In the invention it is possible to use, for example, a chemimechanical pulp containing 70–100% aspen fibers and 0–30% softwood fibers. The bulk, strength properties and stiffness of the pulp can be increased with softwood fibers, in particular spruce fibers. It is also possible by controlling the process parameters of the CTMP process to affect the bulk and stiffness of a pulp made up solely of aspen or a similar raw material.

After defibration, the chemimechanical pulp is usually bleached with, for example, hydrogen peroxide in alkaline conditions to a brightness of 70–88%.

To modify the properties of the initial material, an aspen pulp can, when so desired, be mixed with chemical pulp so that there is obtained for slushing an initial material which nevertheless contains a significant amount (at least 30% by weight) of a chemimechanical pulp. The chemical pulp used is preferably a chemical softwood pulp the proportion of which is in this case 1–50% of the dry weight of the fibers. It is, however, possible to use chemimechanical aspen pulp alone.

The paper pulp is slushed in a manner known per se to a suitable consistency (typically to a solids content of approx. 0.1–1%) and is spread on the wire, where it is formed into a paper or board web. It is possible to add to the fiber slush a filler, such as calcium carbonate, in general in an amount of approx. 1–50% of the weight of the fibers. According to a preferred embodiment of the invention, the paper web is provided with a coating prior to calendering. Coating pastes can be used as single-coat pastes and as so-called pre-coat and surface-coat pastes. In general the coating mix according to the invention contains at least one pigment or mixture of pigments10–100 parts by weight, at least one binding agent 0.1–30 parts by weight, and other additives known per se1–10 parts by weight.

A typical composition of the pre-coat mix is as follows:

| | |
|---|---|
| Coating pigment (e.g. coarse calcium carbonate) | 100 parts by weight |
| binder | 1–20% of the weight of the pigment |
| additives and auxiliary agents | 0.1–10% of the weight of the pigment |
| water | balance |

Water is added to the pre-coat mix so that the dry solids content is generally 40–70%.

According to the invention, the composition of the surface-coat mix or single-coat mix is, for example, as follows:

| | |
|---|---|
| coating pigment I (e.g. fine gypsum) | 10–90 parts by weight |
| coating pigment II (e.g. fine kaolin) | 0–90 parts by weight |
| coating pigment III (e.g. fine carbonate) | 0–90 parts by weight |
| pigment in total | 100 parts by weight |
| binding agent | 1–20 parts by weight |
| additives and auxiliary agents | 0.1–10 parts by weight |
| water | balance |

Water is added to a coating mix such as this so that the dry solids content is typically 50–75%.

According to the invention it is possible to use in the coating mixes presented above pigments having an abrupt particle size distribution, in which case at maximum 35% of the pigment particles are smaller than 0.5 $\mu$m, preferably at maximum 15% are smaller than 0.2 $\mu$m.

The invention is applicable to any pigment. Examples that can be cited of the pigments include precipitated calcium carbonate, ground calcium carbonate, calcium sulfate, aluminum silicate, kaolin (hydrous aluminum silicate), aluminum hydroxide, magnesium silicate, talc (hydrous magnesium silicate), titanium dioxide and barium sulfate, and mixtures thereof. Synthetic pigments can also be used. Of the pigments mentioned above, the main pigments are kaolin, calcium carbonate, precipitated calcium carbonate and gypsum, which in general constitute over 50% of the dry solids in the coating mix. Calcined kaolin, titanium dioxide, satin white, aluminum hydroxide, sodium silico-aluminate and plastics pigments are additional pigments, and their amounts are in general less than 25% of the dry solids in the mix. Special pigments that can be cited include special-quality kaolins and calcium carbonates, as well as barium sulfate and zinc oxide.

The invention is applied especially preferably to calcium carbonate, calcium sulfate, aluminum silicate and aluminum hydroxide, magnesium silicate, titanium dioxide and/or barium sulfate, as well as mixtures thereof, in which case especially preferably the principal pigment in the pre-coat mixes is calcium carbonate or gypsum and in surface-coat mixes and single-coat mixes the principal pigment consists of mixtures of calcium carbonate or gypsum and kaolin.

As an example of a suitable coating composition can be mentioned a mix which contains:

| | |
|---|---|
| precipitated calcium carbonate | 40–90 parts and |
| kaolin | 10–60 parts or |
| gypsum | 10–60 parts |
| and | |
| binder | 1–20% of the pigment |
| thickener | 0.1–10% of the pigment |

Advantageous results have been arrived at by coating a paper web with a coating composition in which at least 30% of the pigment is made up of gypsum. It has been observed, surprisingly, that gypsum pigmentation gives the base paper according to the invention high brightness and high opacity. Especially preferably, gypsum pigment is used for coating a base paper made from an aspen CTMP which possibly contains at maximum 20% softwood fibers and the brightness of which is at least 75%. In this case the ISO brightness of the web can easily be raised with gypsum pigments to at least 85% and the opacity to at least 90% when the grammage is 90 g/m$^2$.

It is possible to use as binders in the coating composition any known binders generally used in paper production. Besides individual binders, it is also possible to use mixtures of binders. Examples of typical binders include synthetic latexes made up of polymers or copolymers of ethylenically unsaturated compounds, e.g. copolymers of the butadiene-styrene type, which possibly also have a comonomer containing a carboxyl group, such as acrylic acid, itaconic acid or maleic acid, and polyvinyl acetate having comonomers that contain carboxyl groups. Together with the materials cited above, it is possible further to use as binders, for example, water-soluble polymers, starch, CMC, hydroxyethyl cellulose and polyvinyl alcohol.

Furthermore, it is possible to use in the coating composition conventional additives and auxiliary agents, such as dispersants (e.g. sodium salt of polyacrylic acid), agents affecting the viscosity and water retention of the mix (e.g. CMC, hydroxyethyl cellulose, polyacrylates, alginates, benzoate), so-called lubricants, hardeners used for improving water-resistance, optical auxiliary agents, anti-foaming agents, pH control agents, and preservatives. Examples of lubricants include sulfonated oils, esters, amines, calcium or ammonium stearates; of agents improving water resistance, glyoxal; of optical auxiliary agents, diaminostilbene disulfonic acid derivatives; of anti-foamers, phosphate esters, silicones, alcohols, ethers, vegetable oils; of pH control agents, sodium hydroxide, ammonia; and finally of preservatives, formaldehyde, phenol, quaternary ammonium salts.

The coating mix can be applied to the material web in a manner known per se. The method according to the invention for coating paper and/or board can be carried out with a conventional coating apparatus, i.e. by blade coating, or by film coating or JET application.

During the coating, a coating layer having a grammage of 5–30 g/m$^2$ is formed at least on one surface, preferably on both surfaces.

An uncoated web or a web coated in the manner described above is thereafter directed to online soft-calendering. By online calendering is meant in this case calendering carried out in connection with the paper machine, without intermediate reeling of the paper.

By soft-calendering is meant calendering in which at least one of the two rolls forming a nip has a soft coating. The linear pressure in the calendering is generally at least 200 kN/m and the speed of the calendering is at least 800 m/min. The gloss of a paper or board product can be affected significantly by the linear pressure and temperature of calendering. In general, glossy paper products are obtained when calendering is carried out at a high linear pressure and a high temperature (e.g. approx. 120–170° C.). The gloss of these products is over 50%. The paper web is calendered in this case in an online calender having at least two nips formed between a hard roll and a soft roll. The linear pressure in the calendering of paper is, for example, approx. 250–450 kN/m.

The temperature of the coated paper web arriving at the calender is, when paper making, calendering and calendering are in the same line, in general approx. 50–60° C. at the beginning of the calendering. According to another embodiment of the invention, the calender rolls are not substantially heated; the initial temperature of the paper web is exploited in this embodiment. This alternative is suitable for the production of matt papers, in which case a calendered paper web having a gloss below 50% is produced. The paper web is in this case calendered at a linear pressure of, for example, 200–350 kN/m.

By means of the invention it is possible to produce coated and calendered material webs having excellent printing properties, good smoothness, and high opacity and brightness. An especially preferred product is a coated offset paper in which high gloss and high opacity and bulk are combined. The grammage of the material web may be 50–450 g/m$^2$. In general the grammage of the base paper is 30–250 g/m$^2$, preferably 30–80 g/m$^2$. By coating a base paper of this type, which has a grammage of approx. 50–70 g/m$^2$, with 10–20 g of coating/m$^2$/side and by calendering the paper there is obtained a product having a grammage of 70–110 g/m$^2$, a brightness of at least 90%, an opacity of at least 90%, and a surface roughness of at maximum 1.3 $\mu$m in glossy paper and at maximum 2.8 $\mu$m in matt paper. The gloss obtained for glossy paper is up to 65% (Hunter 75).

The following non-restrictive examples illustrate the invention. The measuring results indicated in the examples for the paper properties were determined by the following standard methods:

Brightness: SCAN-P66–93 (D65/10°)
Freeness, CSF: SCAN M 4:65
Opacity: SCAN-P8:93 (C/2)
Surface roughness: SCAN-P76:95
Bendtsen roughness: SCAN-P21:67
Gloss: Tappi T480 (75/) and T653 (20/)

EXAMPLE 1

Production of Aspen CTMP

Aspen CTMP was prepared by impregnating the chips with chemicals, by refining the impregnated chips in two steps, and by bleaching the pulp with peroxide.

The following conditions were complied with in the process:

Impregnation of Pulp:

In 2 steps, with peroxide and lye and DTPA (chelating of metals), in addition to recycling of the filtrates, additionally both chemicals are added in dosages of approx. 10–15 kg/tonne.

Refining:

1$^{st}$ step pressurized 4–5 bar, pulp drainability (CSF) approx. 300–400 ml

2$^{nd}$ step open/1–2 bar, pulp drainability (CSF) approx. 150–180 ml, after screening the drainability value drops to the desired level, i.e. approx. 90–100 ml.

Bleaching:

In 2 steps (medium consistency and high consistency) with a small amount of water, peroxide and lye each approx. 30 kg/tonne of pulp, target brightness approx. 80.

Thus a pulp can be produced which has the following properties; in this example, 85% of the fibers were aspen and 15% were spruce.

| | |
|---|---|
| Fressness, CSF | 90 |
| PFI shives, | 0.05% |
| Result of BauerMcNett fiber screening: | |
| retained on 28 mesh | 3.3% |
| 28/48 | 31.9% |
| 48/100 | 19.0% |
| 100/200 | 13.5% |
| passed 200 mesh | 32.3% |
| grammage g/m$^2$ | 64.2 |
| density, kg/m$^3$ | 549 |
| air resistance, Gurley, s | 106 |
| brightness % | 77.5 |
| light scattering coefficient m$^2$/kg | 58.0 |
| tensile index, Nm/g | 35.0 |
| tear index, mN m$^2$/g | 3.3 |
| internal bond strength, J/m$^2$ | 135 |

EXAMPLE 2

Production of Base Paper

Base paper was produced in a production-scale test from the CTMP according to Example 1, as follows:

The base paper was produced from a mixture into which there were dosed:

25% broke derived from the normal production of the mill and consisting of birch sulfate pulp, softwood sulfate pulp and PCC filler 75% fresh pulp containing 50% softwood sulfate pulp refined to the level of SR 25 and 50% aspen CTMP according to Example 1. The aspen CTMP was not postre-fined separately at all at the paper mill; the pulp underwent a very light refining treatment in the so-called machine pulp refining. The machine pulp is made up of softwood sulfate and aspen CTMP together.

In addition, PCC was added to the paper as a filler so that the total filler content (including the filler from the reject) in the machine reels ranged from 11.8 to 13.2%.

The paper machine wire speed was 895 m/min; the possible speed range for this grammage and this paper formula in this machine could be 1100–1200 m/min. The paper was calendered lightly in a machine calender.

Several machine reels of paper were produced for both tests; the grammage in one test was approx. 65 g/m$^2$ and the grammage in the other 55g/m$^2$. The most important quality values of the paper were:

grammage 65.6 g/m$^2$
filler content 12.0%
bulk 1.65 kg/dm$^3$
brightness (D65/10° light), top side of paper 95.2
brightness (D65/10° light), wire side of paper 94.8
opacity 89.6%
Bendtsen porosity 420 ml/min
Bendtsen roughness, top side of paper 306 ml/min
Bendtsen roughness, top side of paper 355 ml/min
internal bond strength 300 J/m$^2$
tensile strength, machine direction of paper 4.1 kN/m
tensile strength, cross direction of paper 1.3 kN/m
tear strength, machine direction of paper 439 mN
tear strength, cross direction of paper 545 mN

EXAMPLE 3

Coating and Calendering of Glossy Paper

Next, base paper according to Example 2 was coated and calendered with a pilot apparatus.

The coating formula was:

Opacarb A 40 (PCC) 60
Hydragloss 90 (clay) 40 parts
Styronal FX 8740 (styrene-butadiene latex) 13 parts
CMC Finnfix 10 0.9 parts
Blancophor PSF 1 part The solids content of the coating paste was 66% and its pH was 8.5.

The coating was carried out by JET application at a speed of 1100 m/min. The target amount of coating was 13 g/m$^2$ on each side of the paper.

After the coating, the paper was calendered as follows:

Speed 900–1100 m/min
Linear pressure range 250–450 kN/m
Calendering temperature 120–160° C.
Nips: 2+2 hard/soft Thus there was obtained paper having very good quality properties in terms of heatset-offset printing. Table 1 compares paper according to the invention with a competitor, at present the paper which is the market leader, the grammage of each paper being 90 g/m$^2$. The competitor's paper was produced using—probably—as the short-fibered pulp a chemical birch pulp or possibly a chemical pulp containing eucalyptus, acacia or so-called mixed hardwood pulp. The gloss and smoothness indicated in the table are mean values calculated from the values of the top side and the wire side of the paper.

TABLE 1

| | Magic Gloss StoraEnso | Paper according to the invention |
|---|---|---|
| Bulk, kg/dm$^3$ | 0.87 | 0.97 |
| Smoothness, PPS10, $\mu$m | 1.4 | 1.3 |
| Gloss % (Hunter 75) | 63 | 65 |
| Opacity % | 92.1 | 94.1 |
| Brightness % (D6510 measurement) | 92.2 | 94.5 |
| b*-tone | −6.0 | −4.1 |

The results of Table 1 are also presented graphically in FIGS. 1–3, which cover several tests on paper produced by the method of the invention, according to how the process parameters of calendering were varied. The base paper and the coating were produced in the same manner in all of the tests.

As is evident from the results in the table above and the accompanying figures, the paper according to the invention is glossier and smoother but, nevertheless, its bulk is more than 10% better than the competitor's bulk. It is essential to note that in Examples 1, 2 and 3 the speed of the apparatus was always within the range of 895–1100 m/min. In practice it is thus possible to implement a machine line wherein paper production, coating and calendering are in the same production line and the speed of the entire line is, for example, 1100–1200 m/min.

Opacity is especially notable in the results of Table 1. Paper produced by the method according to the invention is so much better with respect to opacity that the opacity achieved by the competitors with a grammage 90 g/m$^2$ could by the method according to the invention be achieved already with a paper of 74 g/m$^2$. This calculation is based on the use of the Kubelka-Munk theory.

EXAMPLE 4

Coating and Calendering of Matt Paper

Base paper according to Example 2 was next coated and calendered with a pilot apparatus.

The coating formula was:

Opacarb A 60 (PCC) 80 parts
Suprawhite 80 (clay) 20 parts
Styronal FX 8740 (Styrene-butadiene latex) 13 parts
CMC Finnfix 10 0.7 parts
Stereocoll FD (synthetic thickener) 0.3 parts
Blancophor PSF 1 part
Dispersant 0.15 parts The solids content of the coating paste was 65% and its pH was 8.5.

The coating was carried out by JET application at a speed of 1100 m/min. The target amount of coating was 13 g/m$^2$ on each side of the paper.

After the coating, the paper was calendered as follows:

Speed 900–1100 m/min
Linear pressure range 200–300 kN/m
Roll temperature 50° C.; in practice need not be heated, since the paper web, coming from the paper machine, raises the temperature to this range
Nips: 1 soft/soft Thus a paper was obtained which had very good quality properties in terms of heatset-offset printing. Table 2 compares the paper according to the invention with competitors, the grammage of all of the papers being 90 g/m$^2$. The papers of the competitors had been produced using—probably—as the short-fibered pulp a chemical birch pulp or possibly a chemical pulp containing eucalyptus, acacia or so-called mixed hardwood pulps. The gloss and smoothness indicated in the table are mean values calculated from the values of the top side and the wire side of the paper.

TABLE 2

| | G-Print StoraEnso | KymPrint UPM-Kymmene | Lumimatt StoraEnso | Paper according to the invention |
|---|---|---|---|---|
| Bulk, kg/dm$^3$ | 1 | 0.94 | 0.97 | 1.08 |
| Smoothness, PPS10, $\mu$m | 3.6 | 2.85 | 2.9 | 2.5 |
| Gloss % (Hunter 75) | 15 | 24 | 27 | 20 |
| Brightness % (D6510 measurement) | 93.5 | 96.5 | 95.0 | 95.0 |

TABLE 2-continued

| | G-Print StoraEnso | KymPrint UPM-Kymmene | Lumimatt StoraEnso | Paper according to the invention |
|---|---|---|---|---|
| Opacity % | 93.3 | 93.2 | 93.6 | 95.0 |
| b*-tone | −6.5 | −19 | −6.5 | −4.5 |

The results of Table 2 are also presented graphically in FIGS. 1–3, which cover several tests on paper produced by the method of the invention, according to how the process parameters of calendering were varied. The base paper and coating were produced in the same manner in all of the tests.

The paper according to the invention is smoother but, nevertheless, its bulk is on average over 10% better then the bulk of the best competitors. In matt papers the gloss value is not as essential a quality value as the smoothness of the paper, but even with respect to gloss, the paper according to the invention is within the same range as the competitors.

Opacity is especially notable in the results of Table 2. The paper produced by the method according to the invention is with respect to opacity so much better that the opacity achieved by the competitors with a grammage of 90 g/m$^2$ could be achieved with the paper produced according to the invention already with a 76 g/m$^2$ paper. This calculation is based on the use of the Kubelka-Munk theory.

It is essential to note even in this example that in Examples 1, 2 and 4 the speed of the apparatus was always within the range of 895–1100 m/min. It is thus in practice possible to implement a machine line wherein paper production, coating and calendering are in the same production line and the speed of the entire line is, for example, 1100–1200 m/min.

What is claimed is:

1. A method for producing a calendered paper web, according to which method a fibrous raw material is formed into a paper web in the paper machine and the paper web is coated and the coated paper web is calendered, characterized in that a fibrous raw material is used, at least 30% by weight of which is made up of a chemimechanical pulp of a species of the *Populus* family, and the calendering is carried out at a linear pressure of approximately 250–450 kN/m, a temperature of approximately 120–170° C. and a speed of 800 m/min in an online calender, without intermediate reeling of the web, said calender having at least two nips formed between a hard roll and a soft roll, to produce a coated paper product having a gloss over 50%.

2. The method according to claim 1, characterized in that a fibrous raw material is used which contains CTMP in which at minimum 30% of the fibers are derived from aspen, hybrid aspen, or poplar.

3. The method according to claim 1 characterized in that an aspen CTMP is used in which at minimum 20% of the fibers are in the fiber size fraction of <200 mesh.

4. The method according to claim 1, characterized in that an aspen CTMP is used in which 20–40% of the fibers are in the fiber size fraction of 28/48 mesh and 20–40% in the fiber size fraction of <200 mesh.

5. The method according to claim 1 characterized in that a chemimechanical pulp is used which contains at minimum 50% aspen fibers.

6. The method according to claim 1 characterized in that a chemimechanical pulp is used which contains 70–100% aspen fibers and 0–30% softwood fibers.

7. The method according to claim 1 characterized in that a fibrous raw material is used which contains a mixture of chemimechanical pulp and chemical pulp, the proportion of the chemimechanical pulp being at minimum 30% of the dry weight of the fibers.

8. The method according to claim 7, characterized in that the chemical pulp used is a softwood pulp the proportion of which is 5–50% of the dry solids weight of the fibers.

9. The method according to claim 1 characterized in that the paper web is provided with a coating layer before calendering.

10. The method according to claim 9, characterized in that the paper web is coated with a coating composition containing as a pigment a precipitated calcium carbonate, ground calcium carbonate, kaolin, gypsum, chalk and/or talc.

11. The method according to claim 10, characterized in that the coating is carried out with a coating composition containing

| | |
|---|---|
| precipitated calcium carbonate | 40–90 parts and |
| kaolin | 10–60 parts or |
| gypsum | 10–60 parts |
| and | |
| binding agent | 1–20% of the pigment |
| thickener | 0.1–10% of the pigment. |

12. The method according to claim 10, characterized in that the paper web is coated with a coating composition in which at minimum 30% of the pigment is made up of gypsum.

13. The method according to claim 12, characterized in that an aspen CTMP is used which contains at maximum 20% softwood fibers and the brightness of which is at minimum 70%, and the paper web is coated with a gypsum pigment in order to produce a paper web having a brightness of at minimum 80%.

14. The method according to claim 9 characterized in that the coating is carried out by jet application.

15. The method according to claim 1 characterized in that on at least one surface, of the paper web there is formed a coating layer having a grammage of 5–30 g/m$^2$.

16. The method according to claim 1 characterized in that the calendering speed is at minimum 900 m/min.

17. A method according to claim 1 for producing calendered paper having a predetermined gloss above 50%, wherein in the chemimechanical pulp at least 20% of the fibers are in the fiber size fraction of <200 mesh.

18. Coated and calendered paper produced by a method according to claim 1, wherein the fibrous raw material comprises chemimechanical aspen pulp and 20–40% of the fibers are within the fiber size fraction of 28/48 mesh and 20–40% within the fiber size fraction of <200 mesh.

19. The paper according to claim 18, characterized in that it is coated with a coating composition which contains a gypsum pigment.

20. The paper according to claim 18 characterized in that the grammage of the paper is 50–350 g/m$^2$, the amount of coating is 10–40 g/one side of the paper, and the brightness of the paper is at minimum 80%.

21. The paper according to claim 19, characterized in that the grammage of the paper is at maximum 100 g/m$^2$, the grammage of the base paper is 30–80 g/m$^2$ and the amount of coating is 5–20 g/m2, and the brightness is at minimum 92%.

* * * * *